US008293022B2

(12) United States Patent
Curtius et al.

(10) Patent No.: US 8,293,022 B2
(45) Date of Patent: Oct. 23, 2012

(54) METHOD FOR DETECTING THE QUANTITY OF DISHES IN THE WASHING CONTAINER OF A DISHWASHER AND DISHWASHER FOR CARRYING OUT SAID METHOD

(75) Inventors: Georg Curtius, Dillingen (DE); Michael Rosenbauer, Reimlingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 2116 days.

(21) Appl. No.: 10/536,289

(22) PCT Filed: Nov. 6, 2003

(86) PCT No.: PCT/EP03/12422

§ 371 (c)(1),
(2), (4) Date: Dec. 27, 2005

(87) PCT Pub. No.: WO2004/047608

PCT Pub. Date: Jun. 10, 2004

(65) Prior Publication Data

US 2006/0130876 A1 Jun. 22, 2006

(30) Foreign Application Priority Data

Nov. 27, 2002 (DE) ..... 102 55 380

(51) Int. Cl.
*B08B 7/04* (2006.01)
*B08B 3/00* (2006.01)

(52) U.S. Cl. ..... 134/18; 134/25.2; 134/56 D; 134/58 D

(58) Field of Classification Search ..... None
See application file for complete search history.

(56) References Cited

U.S. PATENT DOCUMENTS 6,622,754 B1 * 9/2003 Roth et al. ..... 134/18

FOREIGN PATENT DOCUMENTS

| | | | |
|---|---|---|---|
| DE | 30 14 663 | A1 | 10/1981 |
| DE | 41 42 517 | A1 | 6/1993 |
| DE | 195 38 580 | A1 | 4/1997 |
| DE | 197 36 347 | A1 | 2/1999 |
| DE | 100 39 075 | A1 | 2/2002 |
| EP | 0 727 179 | A2 | 8/1996 |
| EP | 0 943 287 | A1 | 9/1999 |
| EP | 1 192 893 | B1 | 11/2004 |
| JP | 05137691 | * | 6/1993 |

OTHER PUBLICATIONS

Machine Translation: JP 05-137691, Uchiyama et al. Jun. 1993.*
International Search Report for PCT/EP2003/012422.
Hiroyoshi Nomura et al, Non-linear technologies in a dishwasher, 1995 IEEE International Conference, Mar. 20, 1995, pp. 57-58.

* cited by examiner

*Primary Examiner* — Michael Barr
*Assistant Examiner* — Natasha Campbell
(74) *Attorney, Agent, or Firm* — James E. Howard; Andre Pallapies

(57) ABSTRACT

A dishwasher and a method for detecting the quantity of dishes in the washing container of the dishwasher are provided. The method includes detecting data relating to the motor operation of a circulating pump and detecting data relating to the heat increase in the dishwasher during a pre-washing phase and a heating phase and comparing the detected data with stored target values. A quantity value for the quantity of dishes in the washing container is set based upon a comparison of the detected data with stored target values. The method also includes adapting the washing program according to the set dishes quantity value.

4 Claims, No Drawings

METHOD FOR DETECTING THE QUANTITY OF DISHES IN THE WASHING CONTAINER OF A DISHWASHER AND DISHWASHER FOR CARRYING OUT SAID METHOD

The invention relates to a method for detecting the quantity of dishes in the washing container of a dishwasher and a dishwasher for carrying out said method.

When developing new dishwashers and washing programmes, particular efforts are being made to reduce energy consumption since household appliances, especially dishwashers, are categorised on the basis of their energy consumption.

An important component of the energy consumption is used during heating of the rinsing solution since, depending on the washing programme selected, a quantity of liquid of about 3 to 6 liters must be heated through a temperature difference of up to 50° C. in each part programme section. In order to reduce the energy consumption during a washing programme, in conventional dishwashers it is possible to manually pre-select an economy programme whereby the water consumption is substantially reduced or by selecting a so-called single-basket wash whereby the water consumption can be up to approximately halved, but in any case substantially reduced.

The aim of these selection possibilities is to optimally adapt the respective washing programme and therefore the quantity of water required to the respective quantity of dishes. The afore-mentioned known possibilities for saving, the economy programme or the single-basket wash, must be selected by the user themselves. If the individual crockery baskets are unfavourably loaded (for example, with fairly large pots), however a single-basket wash cannot be selected because, although the number of dishes is small, these are distributed over two crockery baskets in the washing container because of the size of the individual items of crockery. Since the quantity of dishes cannot be set exactly and a distinction can only be made between coarse crockery states, the quantity of liquid used is greater than that required on the basis of the quantity of dishes.

It is thus the object of the invention to provide a method which is suitable for detecting the quantity of dishes in the washing container of a dishwasher so that a programme control adapts the washing programmes to the respective quantity of dishes and to provide a dishwasher for implementing this method.

This object is solved by the method according to the invention.

In the method for detecting the quantity of dishes in the washing container of a dishwasher according to the invention, both the motor operation data of a circulating pump and the heat increase in the dishwasher are detected in a pre-washing phase and in a heating phase and the detected actual values are compared with stored target values, the quantity of dishes in the washing container is determined as a result of said actual-target value comparison and the washing programme is adapted according to the quantity of dishes detected.

The motor operation data and the heat increase are advantageously measured at specific time intervals.

Using the motor operation data, it is possible to determine the quantity of water pumped by the circulating pump and thus to measure, for example, the missing quantities of water accumulating in the dishes or adhering to the dishes. This measured quantity can provide information on the quantity of dishes located in washing container.

According to the invention, however not only the motor operation data is used to detect the quantity of dishes in the washing container but also the temperature required for heating the rinsing solution. This value, known as the heat increase, measures the change in temperature of the flowing water using a temperature sensor arranged, for example at the output of the continuous-flow heater or another heat source intended for heating the rinsing solution.

If, for example, a certain quantity of water is heated in the continuous-flow heater and directed onto the dishes by means of at least one spray device, a temperature equalisation takes place between the dishes and the rinsing solution where the temperature change or the rate of temperature change depends on the respective quantity on the dishes in the washing container. The more dishes there are in the washing container, the slower the rinsing solution heats up during the heating phase since a corresponding cooling of the rinsing solution always takes place as a result of the heating of the dishes. During the heating phase the rinsing solution is pumped several times through the heating device, for example, the continuous-flow heater, by means of a circulating pump so that it is appropriate to measure the water temperature, for example, at the outlet or inlet of the continuous-flow heater.

However, it is not sufficiently reliable to use only the data on the heat increase to detect the quantity of dishes in the washing container since the heat increase data can be substantially falsified as a result of the voltage differences always present in the public power supply. For example, if the dishwasher is operated at a voltage of 250 volts instead of a 230 volt alternating voltage, as a result of the high available electrical power the measurement of the heat increase alone would underestimate the loading state in a washing container loaded with items to be washed and would transmit a signal that the dishwasher is empty to the programme controller.

The operation data of the motor, on the other hand, also vary with the voltage, i.e., the change in voltage or voltage fluctuations are measured and can thus be incorporated in the evaluation of the heat increase values or verify these.

The quantity of dishes in the washing container can only be determined reliably according to the invention by linking the two sets of measurement data, motor operation data and heat increase since any deviation of the motor operation data as a result of voltage fluctuations can be determined and compensated.

For this purpose a plurality of curve or measurement data scenarios are stored in the programme controller which each have a certain quantity of dishes as a result and accordingly comprise characteristic curve profiles of motor operation data and heat increase-target values. Using this "determined" quantity of dishes, it is possible to set the water requirement for the selected washing programme optimised to the respective quantity of dishes.

The method according to the invention thus links two measured values, obtained independently of one another, which can be attributed to different input quantities, actual values. After the method according to the invention has detected the quantity of dishes in the washing container, the quantity of water sufficient for this specific quantity of dishes which has also been determined by empirical measurement data and stored in the programme controller, can be determined so that the water consumption can be reduced substantially as a result of the quantity of water being adapted automatically.

The present invention has succeeded in providing a method for detecting the quantity of dishes in the washing container of a dishwasher so that a programme control adapts the washing programme to the respective quantity of dishes.

In the dishwasher according to the invention for implementing the method according to the invention described previously, both the motor operation data of the circulating pump and the heat increase in the dishwasher are detected by means of suitable sensors at least in a pre-washing phase and in a heating phase, wherein the dishwasher has a programme control in which the detected actual values are compared with stored target values, the quantity of dishes in the washing container is determined as a result of said actual-target value comparison and the washing programme is adapted according to the quantity of dishes detected. The advantages of the method according to the invention described above are thus used in the dishwasher according to the invention.

The present invention has furthermore succeeded in providing a dishwasher for implementing said method.

The invention claimed is:

1. A dishwasher comprising:

means for detecting both a voltage change of a circulating pump and a heat increase in the dishwasher during at least a pre-washing phase and a heating phase; and a programme control in which the detected values are compared with stored target values, the programme control being operable to determine a quantity of dishes in a washing container of the dishwasher as a result of the detected-target value comparison and to adapt the washing programme according to the quantity of dishes detected.

2. A method for detecting quantity of dishes in a washing container of a dishwasher, comprising:

detecting data relating to a voltage change of a circulating pump during at least one of a pre-washing phase and a heating phase;

detecting data relating to a heat increase in the dishwasher during at least one of the pre-washing phase and the heating phase;

comparing the detected data relating to the voltage change of the circulating pump and the detected data relating to the heat increase in the dishwasher with stored target values;

setting a quantity value for the quantity of dishes in the washing container based upon a comparison of the detected data relating to the voltage change of the circulating pump and to the heat increase in the dishwasher with stored target values; and adapting a washing programme according to the quantity value of dishes that is set via the step of setting a quantity value for the quantity of dishes in the washing container.

3. The method according to claim 2, wherein the step of detecting data relating to the heat increase in the dishwasher during at least one of the pre-washing phase and the heating phase includes measuring the voltage change and the heat increase at specific time intervals.

4. A dishwasher, comprising:

a washing container for retaining therein a quantity of dishes;

a heating device for heating a rinsing solution comprising a quantity of water;

at least one spray device for directing the rinsing solution that has been heated onto the dishes;

a circulating pump for circulating the rinsing solution through the heating device after the rinsing solution has been directed onto the dishes such that heat is imparted by the heating device to the rinsing solution, whereupon the now-further heated rinsing solution can again be directed by the at least one spray device onto the dishes, the rinsing solution undergoing cooling upon contact with the dishes as a result of a heat exchange from the relatively hotter rinsing solution to the relatively cooler dishes, and the heating device operating to provide a heat increase to ensure that the heat imparted to the rinsing solution brings the rinsing solution to a desired temperature before the rinsing solution is directed by the at least one spray device onto the dishes;

a voltage sensor for sensing data relating to voltage change of the circulating pump during at least one of a pre-washing phase and a heating phase;

a heat increase sensor for sensing data relating to the heat increase in the dishwasher during at least one of the pre-washing phase and the heating phase; and a programme control for comparing the voltage change data and the heat increase data with stored target values, for setting a quantity value for the quantity of dishes in the washing container based upon a comparison of the voltage change data and the heat increase data with the stored target values, and for adapting a washing programme according to the dishes quantity value.

* * * * *